US007429021B2

(12) United States Patent
Sather et al.

(10) Patent No.: US 7,429,021 B2
(45) Date of Patent: Sep. 30, 2008

(54) SINK SUPPORT SYSTEM

(76) Inventors: Steven B. Sather, 17712 Gothard St., Unit #B, Huntington Beach, CA (US) 92647; Thomas M. Jones, 17712 Gothard St., Unit #B, Huntington Beach, CA (US) 92647

( * ) Notice: Subject to any disclaimer, the term of this patent is extended or adjusted under 35 U.S.C. 154(b) by 24 days.

(21) Appl. No.: 11/549,924

(22) Filed: Oct. 16, 2006

(65) Prior Publication Data

US 2008/0087778 A1 Apr. 17, 2008

(51) Int. Cl.
*E03C 1/33* (2006.01)
*F16M 11/00* (2006.01)

(52) U.S. Cl. ..... 248/201; 248/200.1; 4/633

(58) Field of Classification Search ..... 248/201, 248/200.1, 27.1; 4/633, 643
See application file for complete search history.

(56) References Cited

U.S. PATENT DOCUMENTS

| | | | | |
|---|---|---|---|---|
| 1,740,553 | A | | 12/1929 | Schmiedeknecht |
| 2,429,455 | A | | 10/1947 | Dellon |
| 2,770,436 | A | * | 11/1956 | Linhardt, Jr. ..... 248/57 |
| 2,809,022 | A | | 10/1957 | Rudolph |
| 3,425,655 | A | | 2/1969 | Cogdill |
| 4,022,415 | A | * | 5/1977 | Roderick et al. ..... 248/298.1 |
| 4,088,290 | A | | 5/1978 | Novello |
| 4,122,762 | A | | 10/1978 | Williams |
| 4,432,106 | A | | 2/1984 | Smith |
| 5,386,959 | A | | 2/1995 | Laughlin et al. |
| 5,505,419 | A | | 4/1996 | Gabrius |
| 5,538,206 | A | | 7/1996 | Sather |
| 5,743,501 | A | | 4/1998 | Rapp |

FOREIGN PATENT DOCUMENTS

WO WO 02/098267 A2 12/2002

OTHER PUBLICATIONS

Sink Setter brochure, The E-Z Way To Under-Mount Sinks! (2 pages).
Sink Setter, Installation Instructions, 1 Page, Model PW-99, E-Z Way Sink Leveling Bracket for Undermounting Applications, Precision Works, Huntington Beach, CA 92647.
Photograph of Sink Setter, Model PW-99.

* cited by examiner

*Primary Examiner*—Anita M King
(74) *Attorney, Agent, or Firm*—Larry K. Roberts

(57) ABSTRACT

An exemplary embodiment of a system for mounting a sink to a support structure includes first and second support members. The first and second support members are adapted for fitting together along a range of positions to provide a variable length sink support system. Leveling devices are adapted for engagement with the support member and for contacting sink surfaces.

6 Claims, 5 Drawing Sheets

SINK SUPPORT SYSTEM

BACKGROUND

Installation of sinks in counters used in kitchens, bathrooms and other facilities can be time consuming. The different sink sizes and sink types available to the homeowner or commercial user today present challenges in efficiently mounting the sinks.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
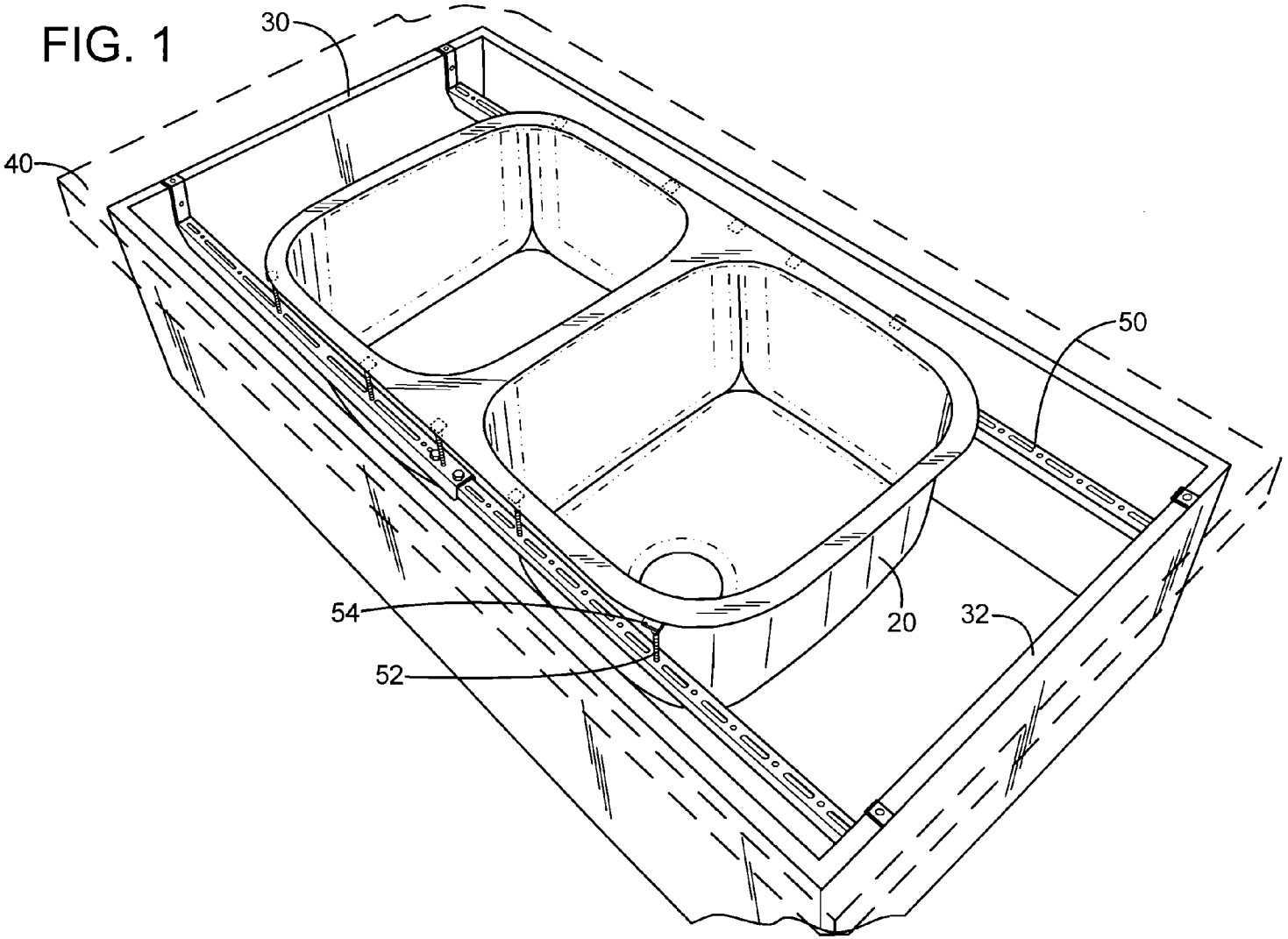
FIG. 1 is an isometric view of an exemplary embodiment of an application of a sink support system to support a double sink in a counter.

In the following detailed description and in the several figures of the drawing, like elements are identified with like reference numerals.

An exemplary embodiment of a sink setting system is depicted in an exemplary double sink installation in FIG. 1. The system includes a pair of support cross-members 50, which are positioned on opposite sides of a double steel sink 20. The cross-members 50 are attached to structural supports 30, 32, which in an exemplary embodiment may be cabinet walls. The sink 20 may be supported by a plurality of leveling bolts 52 and associated end caps 54 which are assembled to the respective cross-members. After the sink is positioned on the leveling bolts, a countertop 40 (illustrated in phantom in FIG. 1) may be positioned over the cabinet with a sink opening formed therein.

An exemplary embodiment of the cross-members 50 is illustrated in FIGS. 2-10. A cross-member 50 may include telescoping lower and upper longitudinal channel members 60 and 70. In an exemplary embodiment, the longitudinal members are each of a generally U-shaped construction, with a bracket formed at one end thereof. In this exemplary construction, member 60 is formed with web portion 60A connecting leg portions 60B, 60C. Similarly member 70 is formed with web portion 70A connecting leg portions 70B, 70C. The web portion 60A of the upper member 60 is wider than the web portion 70A of the lower member 70, to allow the lower member to nest inside the upper member 60.

In an exemplary embodiment, member 60 has a bracket 62 formed at one end thereof, adapted for attaching the member to a support structure 30. The bracket 62 may be integrally formed with the web portion 60A, so that vertical portion 62A is bent or formed at a right angle relative to the web portion 60A. The distal end 62B of the portion 62A may be bent or formed at a right angle relative to portion 62A to provide a support area for positioning against the support structure, with holes formed in portions 62A and 62B to receive threaded fasteners. Similarly, the lower member 70 has a bracket 72 formed at one end thereof, which may comprise portions 72A and 72B.

In an exemplary embodiment, the bracket portions of each member 60 and 70 may have the same width, even though the web portions of the members 60 and 70 are not the same width. By making the bracket portions 62B, 72B the same width, installation may be facilitated in the case in which the top surface of the support structure 30, 32 is routed out to allow the flush fit of the countertop 40.

The members 60 and 70 in an exemplary non-limiting embodiment may be fabricated from cold rolled steel; the steel may have a zinc coating applied for corrosion protection. An exemplary thickness of the steel may be 3/16 inch. Other materials and/or thicknesses may alternatively be employed.

In an exemplary embodiment, each member 60 and 70 has an alternating pattern of slots and threaded openings formed in the web portion. The respective patterns may be selected to provide a relatively high degree of adjustability in the length of the assembly of members 60 and 70, while providing relatively close spacing of positions for leveling bolts over a broad range of assembly lengths.

Figures 2, 3, 3A:
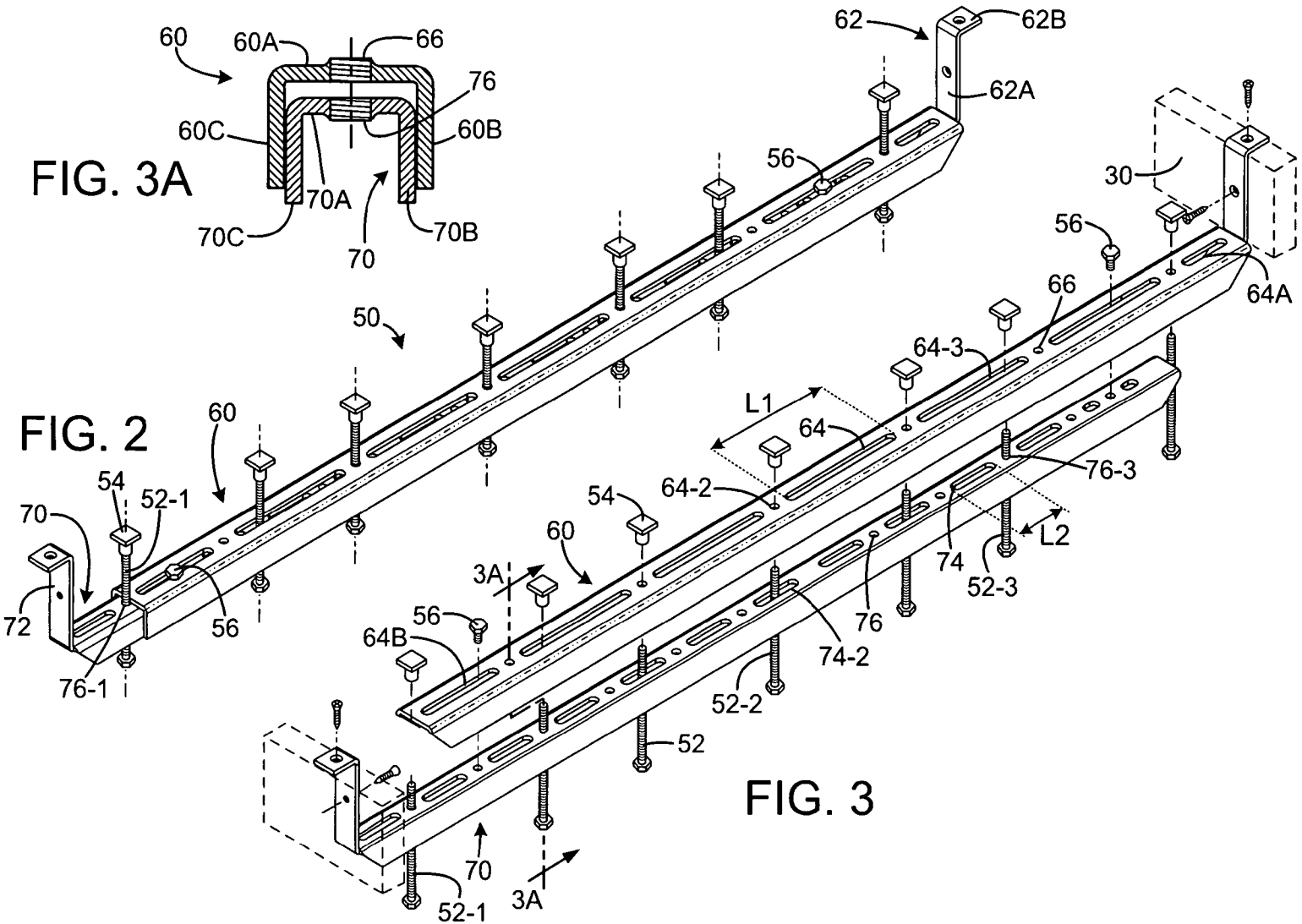
FIG. 2 is an isometric view of an exemplary embodiment of a cross member bracket.
FIG. 3 is an isometric exploded view of the cross member bracket of FIG. 2 on vertical supports.
FIG. 3A is a cross-sectional view taken along line 3A-3A of FIG. 3.
Figure 4:
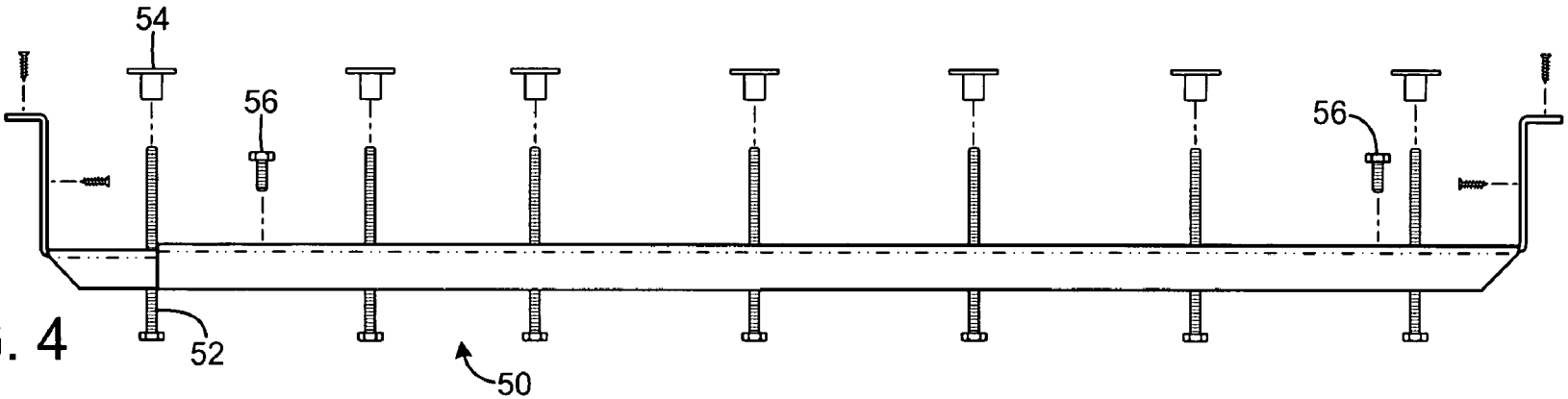
FIG. 4 is a side view of an exemplary embodiment of a cross member bracket.
Figure 5:
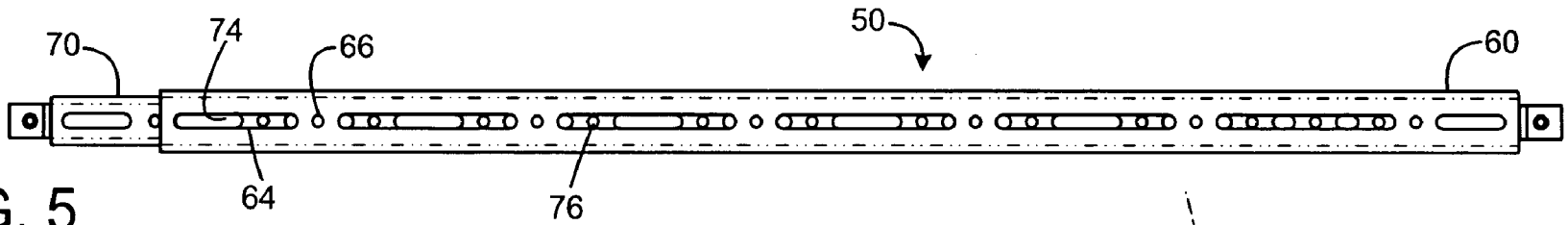
FIG. 5 is a top view of the cross member bracket of FIG. 4.

FIG. 3 illustrates an exemplary embodiment in which the upper member 60 has a plurality of slots 64 formed along its longitudinal extent, alternating with threaded bores 66. The lower member 70 has a plurality of slots 74 formed along its longitudinal extent, alternating with threaded bores 76. In an exemplary embodiment, the bores 66 and 76 may be of the same diameter and thread size. The slots 64 and 74 are sized to allow the leveling bolts 52 to pass through, and the threaded bores 66 and 76 are sized to threadingly accept the threaded leveling bolts 52. Thus, a leveling bolt 52 may be threaded into either a bore 66 or a bore 76 in a sink supporting position, and may be inserted through either a slot 64 in member 60 or a slot 76 in member 70, or in some positions, will not be inserted through a slot in either member. For example, FIGS. 2-3 depict a leveling bolt 52-1 which is threaded through a bore 76-1 in the lower member which is not overlapped by the upper member 60 in its assembled exemplary configuration. Leveling bolt 52-2 is passed through slot 74-2 in the lower member and threaded through bore 66-2 in the upper member. Leveling bolt 52-3 is threaded through bore 76-3 in the lower member and threaded through bore slot 64-3 in the upper member.

In an exemplary embodiment, the threaded holes may be formed by extrusion or punching holes and tapping the holes to form the threads. Alternatively, the holes may be formed by drilling and tapping. Other techniques may be used to provide a female threaded fastener to engage the leveling bolts, e.g. nuts attached, e.g. by welding, pressing (as in PIM nuts), brazing or soldering, to surfaces of the channel members in alignment with holes formed in the channel members. Preferably, the female threaded fasteners are positioned so as not to interfere with the relative movement of the channel members 60, 70 along their range of movement. This may facilitate an extended range of adjustment positions, so that the channel members may virtually completely overlap to allow the system 50 to be set to a position such that the overall length of the system is only slightly longer than the length of one of the channel members.

In an exemplary embodiment, for example, depicted in FIG. 3A, in which the threaded holes are formed by extrusion or punching, the material surrounding the opening may protrude above or below the surface of the web portion, depending on the direction of the extrusion or punching. The protruding material for channel member 60 surrounding the hole 66 protrudes above the web portion, while the protruding material for channel 70 surrounding the hole 76 protrudes below the web portion. In this way, the protruding portions of the threaded fastener structures do not interfere with the sliding fit of the members 60, 70. The two members may be positioned in a fully overlapped position such that the distal end of one member comes into contact with the bracket portion of the other member. This is the case for the exemplary embodiment in which both channel members are of the same length. In other embodiments, the channel members may have different lengths.

Figure 11:
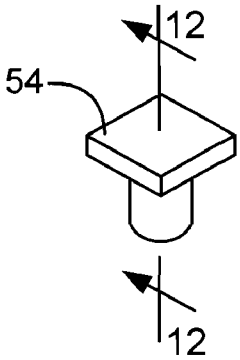
FIG. 11 is an isometric view of a cap used to support a sink in an exemplary embodiment of a sink support system.
Figure 12:
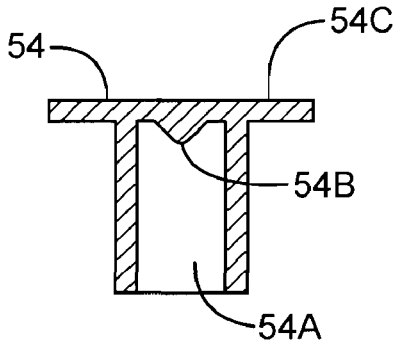
FIG. 12 is a cross-sectional view taken along line 12-12 of FIG. 11.

Each leveling bolt 52 may have an end cap 54 positioned on its distal end to provide a flat cap surface to bear against the lower surface of a sink. FIGS. 11-12 depict an exemplary embodiment of an end cap 54, which has an interior hollow or open region 54A which receives the end of the leveling bolt 52, and a dimple region 54B to bear against the end of the bolt, reducing friction when the bolt is turned. The cap includes a top planar surface 54C which bears against the underside of the rim of the sink; in an exemplary embodiment, the cap surface is about ¾ inch by ¾ inch in size, with rounded corners to reduce marring of sink surfaces in the event the cap turns with the leveling bolt. In an exemplary embodiment, the corners of the cap may be formed with a ⅛ inch radius. An edge of the cap may be set close to the sink and prevented from turning by the sink.

In an exemplary embodiment, a set of the slots 64 in the upper member 60 have a slot length L1 which is larger than a slot length L2 of a set of the slots 74 in the lower member 70. This provides an extended exposure of the threaded bores 76 in the lower member through the longer slots in the upper member. Slots adjacent the ends of the members may have lengths different from L1 or L2. For example, slots 64A and 64B may be shorter than L2. In an alternate embodiment, a set of slots in the lower member may have a longer longitudinal extent than a set of slots in the upper member.

It will be appreciated that the support members 60 and 70 may be fabricated of various lengths to accommodate larger variations in sink installations. For example, in one exemplary embodiment, the members 60 and 70 may each have a length of about 25 inches, with dimension L1 about 3¼ inch, and dimension L2 about 1¼ inch. This may provide an adjustment range for the assembly 50 in a range of about 25 inches to about 47 inches in this example. The web portions in this example may have a width of 1 1/16 inch for member 60 and ⅞ inch for member 70, with leg portion lengths of ¾ inch for member 60 and ⅝ inch for member 70. In another exemplary embodiment, the members 60 and 70 may have a length of about 14 inches, with lengths L1 and L2 of the same or similar lengths as for the exemplary longer embodiment, to provide an adjustable length range between about 14⅛ inches and 26 inches. The web portions in this example may have a width of 1 1/16 inch for member 60 and ⅞ inch for member 70, with leg portion lengths of 9/16 inch for member 60 and ⅞ inch for member 70.

In an exemplary embodiment, the slot and threaded bore patterns in the upper and lower channel members are adapted to provide a capability of positioning leveling bolts in a relatively closely spaced relationship. While some sink setting applications may not need such a distributed supporting arrangement along the edge of the sink, other applications may benefit from such an arrangement. Steel sinks for example have some relative flexibility of the sink along its edge, and may be held more securely in place by a system of relatively closely spaced leveling bolts and caps, e.g. including three, four or even more leveling bolts. Cast iron sinks are relatively rigid, and may be supported in some installations by fewer leveling bolts along an edge, e.g. two leveling bolts.

In an exemplary embodiment, with the exemplary slot dimensions L1 and L2 given above, the leveling bolts may be positioned at a spacing of four inches or less. Of course, in other embodiments, this minimum spacing distance may vary.

The channel members 60 and 70 may be secured together at a selected position within the adjustment range. In an exemplary embodiment, the members may be fixed in position by threaded fasteners 56, which may be passed through a slot 64 in the upper channel member 60 and threadingly received in a threaded hole 76 in the lower member 70, and tightened in place so that the cap of the threaded fastener bears against the surface of the upper channel member 60. Alternatively, to provide additional flexibility for placement of a leveling bolt, the fasteners 56 may be inserted through overlapping slots in the upper and lower members, and secured with a nut. In an exemplary embodiment, the fasteners 56 and leveling bolts 52 are the same outer diameter dimension and thread size so that the fasteners and bolts may each be threadingly received in a threaded hole 66 or 76.

In an exemplary embodiment, the leveling bolts 52 may have an outer diameter of ¼ inch and a length of 3½ inches. The fasteners 56 may have an outer diameter of ¼ inch and a length of ¾ inch.

Figure 10:
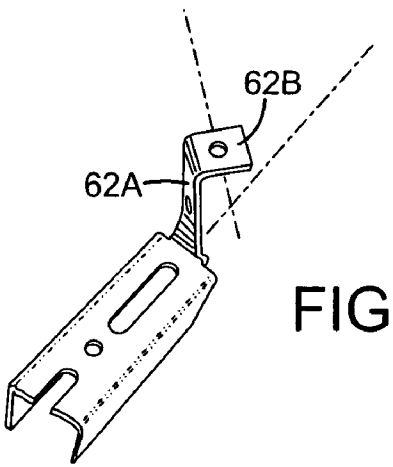
FIG. 10 is a broken-away isometric view of an end portion of a cross member bracket supported on a vertical support in a non-perpendicular arrangement to the vertical support.
Figure 9:
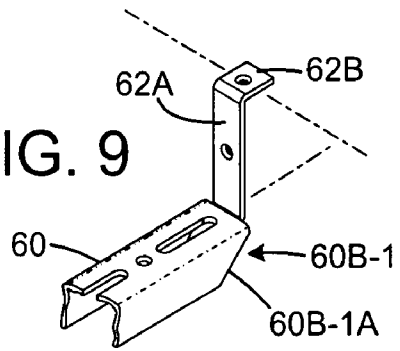
FIG. 9 is a broken-away isometric view of an end portion of a cross member bracket supported on a vertical support in a generally perpendicular arrangement to the vertical support.
Figure 6:
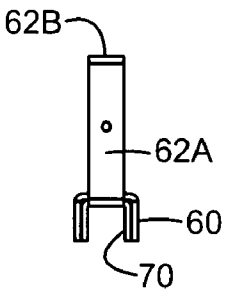
FIG. 6 is an end view of the cross member bracket of FIG. 4.
Figure 8:
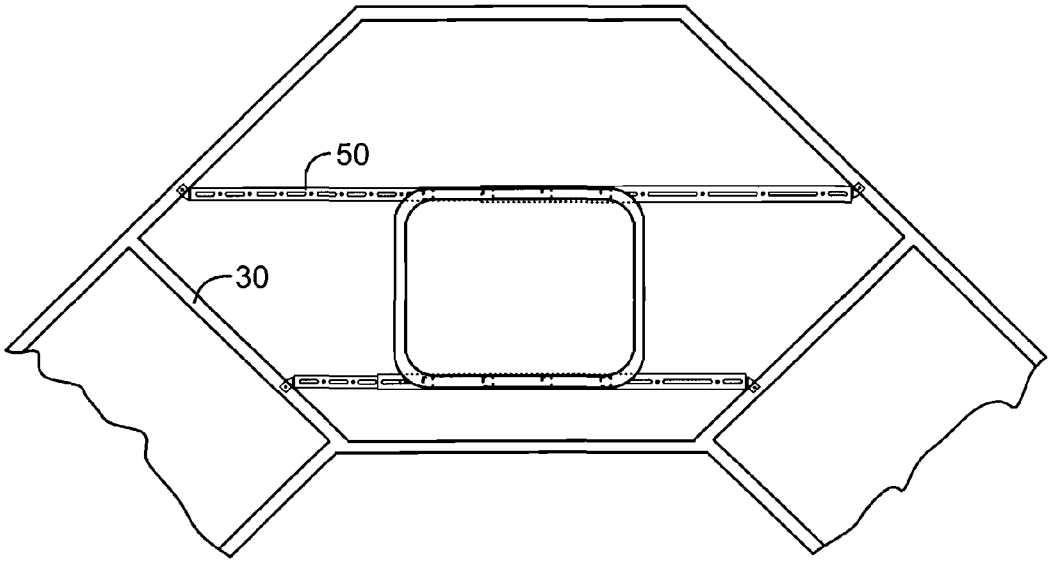
FIG. 8 is a diagrammatic top view of an exemplary installation of a sink in a corner area of a counter using a sink support system.

In an exemplary embodiment, the channel members 60 and 70 may be fabricated such that the vertical bracket portions 62A may be twisted to allow installation of a sink to vertical supports which are parallel to each other or perpendicular to the longitudinal extent of the channel members. Such twisting is depicted in FIG. 10, for a sink installation in a corner as depicted in FIG. 8. The channel member 60 and 70 may be fabricated with relieved portions in the channel legs adjacent the brackets, to facilitate twisting of the bracket portions and provide a clearance bracket region so that the ends of the channel legs do not interfere with the vertical supports in an installation in which the vertical supports are not perpendicular to the longitudinal axis of the sink supports 50. An exemplary relieved portion 60B-1 is depicted in FIG. 9. Preferably both channel members and each channel leg portion is fabricated with an end clearance region in a similar fashion. These relieved clearance portions may have an edge, e.g. edge 60B-1A, which forms an acute angle with the bottom edge of the channel leg portion, e.g. 45 degrees. The greater the angle, the more clearance will the relieved portion provide. In one exemplary embodiment, e.g. the embodiment of FIG. 3, both the bracket end and the distal end of the members 60 and 70 are fabricated with the relieved portions, so that in a fully overlapped position, each end of the structure may be provided with clearance regions. In another embodiment, for example, the embodiment of FIG. 2, and FIG. 4, only the bracket ends of the members 60 and 70 may be provided with the relieved portions.

In an exemplary embodiment, the clearance regions may also allow an installed sink to be removed from below, without first removing a countertop or the fasteners attaching the bracket portions to the vertical supports. For example, by removing the fasteners 56 and leveling bolts 52 from below the sink, the channels members may be bent downwardly and the sink removed from below in some applications.

Figure 7:
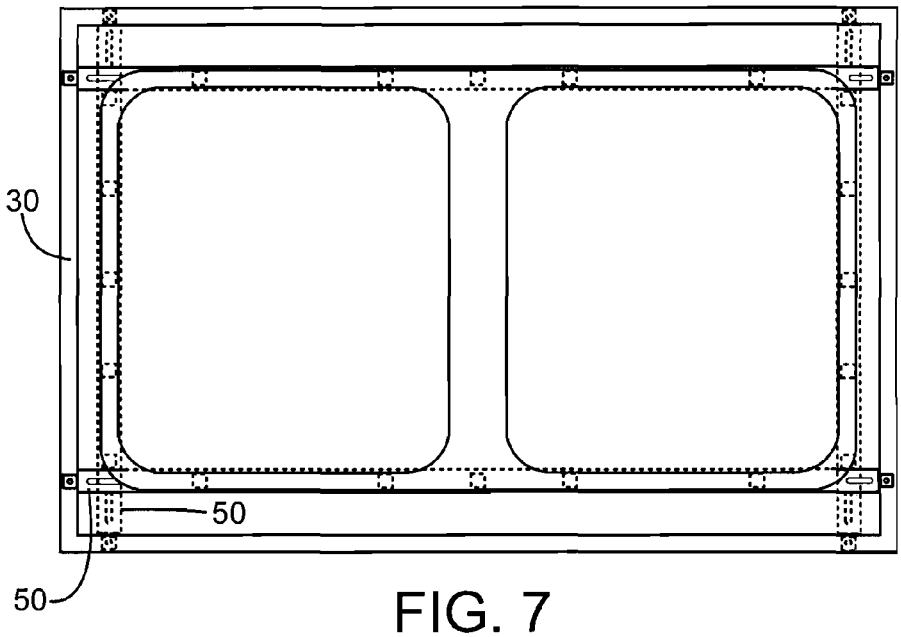
FIG. 7 is a diagrammatic top view of an exemplary installation of a double sink system in a counter, depicting two possible support configurations with a sink support system.

The variable length and wide adjustment range of the sink support system 50 may lend itself to alternatives in installation. For example, for some sinks, arranging the support systems from front to back along side edges of the sink may be utilized, and this may provide greater flexibility in making faucet, disposal and other plumbing connections along the back side of the sink. For other installation, side to side installations may be employed, particularly for long sinks such as stainless steel installations. FIG. 7 depicts both front-to-back and side-to-side installation techniques. Here, the side-to-side sink supports are shown in solid line, and the front-to-back alternative sink supports are depicted in phantom line. FIG. 8 depicts an exemplary installation in a corner.

An exemplary sink installation may include a sequence of the following steps:

1. Determine the best way to support the sink for the installation either using side-to-side or front to-back supporting methods. The clearing of the faucets may impact this determination.

2. Slide the channel members 60, 70 of one assembly 50 together (one inside the other) and open them up to set tight against the walls of the cabinet. Place a bolt or fastener 56 at each end at the farthest point possible where the bolt goes through the top half and into the threaded lower channel member 70. For the longest extensions, one of the fasteners may be used with a nut through both slots in the channel members to leave room for a leveling bolt 52. It works well to space the leveling bolts at 4 inch centers if possible.

3. Thread the leveling bolts 52 through the threaded holes or bores 66 or 76 in a pattern that supports the sides of the sink evenly. Raise the heights of the caps 54 to a point close to the same height of the bracket portions 62B, 72B at either end. Repeat the process for the second sink support assembly 50.

Figure 13:
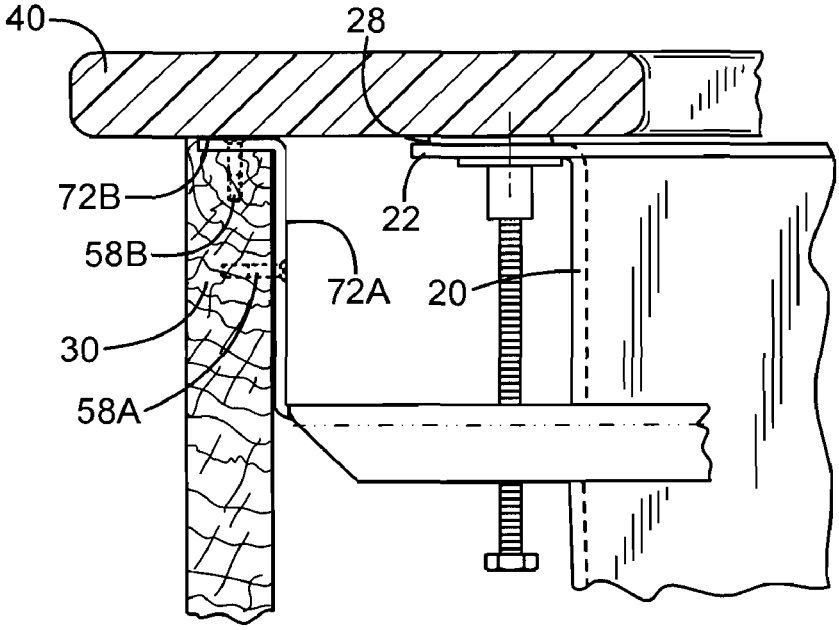
FIG. 13 is a broken-away side view of a cross member bracket of a sink support system in an exemplary sink installation, depicting a cap supporting an edge of the sink.

4. Slide the sink support systems 50 tight against the underside walls of the sink 20 and under the sink rim 22 (FIG. 13). Place the sink support systems and the sink into the desired position. Lay a level or straight edge across the top of the cabinet and adjust the leveling bolts 52.

5. Recess the horizontal portions 62B, 72B into the vertical support edge if needed; allowing the countertop to sit flush (as depicted in FIG. 13). Install the screws 58A, 58B into the vertical support 30 to anchor the ends of the sink support systems 50 to the vertical supports 30, e.g. to the cabinet walls. Caulk the rim of the sink with caulk 28 to provide a seal as the sink is raised back up into position during the final step.

6. Place the countertop 40 (with the sink opening pre-cut) in position and raise the leveling bolts 52 to finalize the sink position (See FIG. 13).

Although the foregoing has been a description and illustration of specific embodiments of the invention, various modifications and changes thereto can be made by persons skilled in the art without departing from the scope and spirit of the invention as defined by the following claims.

What is claimed is:

1. A sink setting system for mounting a sink to a support structure, the system comprising:

first and second channel members, the first channel member having a first bracket portion at a bracket end thereof, the second channel member having a second bracket portion at a bracket end thereof, each of the channel members including a web portion connecting opposed leg portions, and wherein the second channel member is adapted to nest into the first channel member such that the respective web portions are in a facing relationship, along a range of positions to provide a variable length sink support system;

wherein said first and second channel members have clearance bracket regions formed in the respective channel leg portions adjacent their respective bracket ends, and said first and second channel members have clearance regions formed in the respective channel leg portions adjacent distal ends of the channel members from their respective bracket ends;

a plurality of first slots and a plurality of first threaded fastener structures formed in or attached to the web portion of the first channel member;

a plurality of second slots and a plurality of second threaded fastener structures formed in or attached to the web portion of the second channel member;

wherein the plurality of said first slots overlap one or more of said second threaded fastener structures at a plurality of positions in said range of positions, and the plurality of said second slots overlap one or more of said first threaded fastener structures at said plurality of positions;

a plurality of leveling devices adapted for engagement with either said first threaded fastener structure or said second threaded fastener structures; and a plurality of fastening devices for fastening said first and second channel members together at a position in said range of positions, said fastening devices adapted to be inserted through one of a first slot or a second slot to fasten said first and second channel members together.

2. The system of claim 1, wherein said first slots have a first length dimension, and said second slots have a second length dimension which is smaller than said first dimension.

3. The system of claim 2, wherein said first and second channel members are adapted to provide either a first threaded fastener structure or a second threaded fastener structure in alignment with either a respective second slot or a first slot at a leveling device interval spacing along a longitudinal extent of the system which does not exceed a predetermined minimum spacing distance.

4. The system of claim 3, wherein said minimum spacing distance is about four inches.

5. The system of claim 1, in which the leveling device include a threaded bolt.

6. The system of claim 1, wherein the plurality of first slots and first threaded fastener structures and said plurality of second slots and second threaded structures are arranged in respective alternating patterns.

* * * * *